US006835023B1

(12) United States Patent
Paterson

(10) Patent No.: US 6,835,023 B1
(45) Date of Patent: Dec. 28, 2004

(54) REFLECTIVE TRAFFIC PANEL

(76) Inventor: John D. Paterson, 6 Florida Street, Mount Waverley, Victoria 3149 (AU)

( * ) Notice: Subject to any disclaimer, the term of this patent is extended or adjusted under 35 U.S.C. 154(b) by 0 days.

(21) Appl. No.: 10/298,779

(22) Filed: Nov. 18, 2002

Related U.S. Application Data

(63) Continuation-in-part of application No. 09/727,408, filed on Dec. 1, 2000, now abandoned.

(51) Int. Cl.[7] ..... E01F 15/02

(52) U.S. Cl. ..... 404/6; 404/9; 256/13.1; 116/63 R

(58) Field of Search ..... 404/6, 9, 10, 12, 404/14; 256/1, 13.1; 116/63 C, 63 P, 63 R

(56) References Cited

U.S. PATENT DOCUMENTS

| | | | | | |
|---|---|---|---|---|---|
| 4,190,380 | A | | 2/1980 | Almer et al. | |
| 4,249,832 | A | * | 2/1981 | Schmanski | 404/6 |
| 4,338,041 | A | * | 7/1982 | Schmanski | 404/9 |
| 4,678,292 | A | | 7/1987 | Miyatani et al. | |
| 4,751,893 | A | * | 6/1988 | Brantley | 116/63 R |
| 4,770,495 | A | | 9/1988 | Lees | |
| 4,954,009 | A | * | 9/1990 | Kellison | 404/6 |
| 4,978,207 | A | | 12/1990 | Gillner et al. | |
| 5,015,119 | A | * | 5/1991 | Schmanski | 404/12 |
| 5,022,781 | A | * | 6/1991 | Smith | 404/6 |
| 5,049,001 | A | * | 9/1991 | Dinitz | 404/7 |
| 5,149,061 | A | * | 9/1992 | Borgnini | 256/24 |
| 5,181,695 | A | * | 1/1993 | Arthur | 256/13.1 |
| 5,190,394 | A | * | 3/1993 | Mallon et al. | 404/6 |
| D341,098 | S | | 11/1993 | Yodock | |
| 5,443,324 | A | | 8/1995 | Sullivan | |
| 5,453,916 | A | | 9/1995 | Tennis et al. | |
| 5,501,545 | A | | 3/1996 | Walter | |
| 5,599,132 | A | | 2/1997 | Hughes, Jr. | |
| 5,641,241 | A | | 6/1997 | Rushing | |
| 5,685,665 | A | | 11/1997 | Lembo | |
| 5,791,811 | A | * | 8/1998 | Yoshino | 404/6 |
| 5,938,370 | A | | 8/1999 | Gzybowski | |
| 6,084,709 | A | | 7/2000 | Nakade | |
| 6,200,063 | B1 | | 3/2001 | Fritzinger | |
| 6,505,994 | B1 | * | 1/2003 | Attar | 404/16 |

FOREIGN PATENT DOCUMENTS

| | | | | | |
|---|---|---|---|---|---|
| JP | 03169902 | A | * | 7/1991 | E01F/9/00 |
| JP | 06057714 | A | * | 3/1994 | E01F/9/00 |

* cited by examiner

*Primary Examiner*—Robert E. Pezzuto
*Assistant Examiner*—Alexandra K. Pechhold

(57) ABSTRACT

A reflective traffic guidance system is disclosed for allowing vehicle drivers easier viewing of forward traffic by use of the reflective sides of the traffic barricade. The system includes a traffic barrier with a front surface, a substrate on the traffic barrier positioned adjacent to the front surface of the traffic barrier, and a reflective surface on the substrate for reflecting incident light in a substantially specular manner and being substantially incapable of reflecting incident light in a retroreflective manner. Optionally, the traffic barrier may comprise a traffic panel that may be placed on or over conventional concrete barriers or guardrails or may be used alone.

12 Claims, 7 Drawing Sheets

REFLECTIVE TRAFFIC PANEL

CROSS REFERENCE TO RELATED APPLICATION

This application is a continuation-in-part of application Ser. No. 09/727,408, filed Dec. 1, 2000 now abandoned.

BACKGROUND OF THE INVENTION

1. Field of the Invention

The present invention relates to traffic barricades and more particularly pertains to a new reflective traffic barrricade for allowing vehicle drivers easier viewing of forward traffic by use of the reflective sides of the traffic barricade.

2. Description of the Prior Art

The use of traffic barricades is known in the prior art. More specifically, traffic barricades heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,978,207; 5,599,132; 4,770,495; 5,641,214; 5,685,665; Des. 341,098; and 5,938,370.

In particular, the prior art teaches many traffic barriers that are intended to be highly visible to drivers, and thus include many retroreflective surfaces that serve only to reflect light back to its source, so that light emitted from the lights of a vehicle are directed back toward the vehicle from which the light originated, and the operator in the originating vehicle, for the purpose of indicating to the operator the presence of the traffic barrier without necessarily giving any indication to the operator of the presence (or absence) of other vehicles on the road in the vicinity of the traffic barrier or the vehicle.

In these respects, the reflective traffic barrricade according to the present invention substantially departs from the conventional concepts and designs of the prior art, and in so doing provides an apparatus primarily developed for the purpose of allowing vehicle drivers easier viewing of forward traffic by use of the reflective sides of the traffic barricade.

SUMMARY OF THE INVENTION

In view of the foregoing disadvantages inherent in the known types of traffic barricades now present in the prior art, the present invention provides a new reflective traffic barrricade construction wherein the same can be utilized for allowing vehicle drivers easier viewing of forward traffic by use of the reflective sides of the traffic barricade.

The general purpose of the present invention, which will be described subsequently in greater detail, is to provide a new reflective traffic barrricade apparatus and method which has many of the advantages of the traffic barricades mentioned heretofore and many novel features that result in a new reflective traffic barrricade which is not anticipated, rendered obvious, suggested, or even implied by any of the prior art traffic barricades, either alone or in any combination thereof.

To attain this, the present invention generally comprises a traffic barrier with a front surface, a substrate on the traffic barrier positioned adjacent to the front surface of the traffic barrier, and a reflective surface on the substrate for reflecting incident light in a substantially specular manner and being substantially incapable of reflecting incident light in a retroreflective manner. Optionally, the traffic barrier may comprise a traffic panel that may be placed on or over conventional concrete barriers or guardrails or may be used alone.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new reflective traffic barrricade apparatus and method which has many of the advantages of the traffic barricades mentioned heretofore and many novel features that result in a new reflective traffic barrricade which is not anticipated, rendered obvious, suggested, or even implied by any of the prior art traffic barricades, either alone or in any combination thereof.

It is another object of the present invention to provide a new reflective traffic barrricade which may be easily and efficiently manufactured and marketed.

It is a further object of the present invention to provide a new reflective traffic barrricade which is of a durable and reliable construction.

An even further object of the present invention is to provide a new reflective traffic barrricade which is susceptible of a low cost of manufacture with regard to both materials and labor, and which accordingly is then susceptible of low prices of sale to the consuming public, thereby making such reflective traffic barrricade economically available to the buying public.

Still yet another object of the present invention is to provide a new reflective traffic barrricade which provides in the apparatuses and methods of the prior art some of the advantages thereof, while simultaneously overcoming some of the disadvantages normally associated therewith.

Still another object of the present invention is to provide a new reflective traffic barrricade for allowing vehicle drivers easier viewing of forward traffic by use of the reflective sides of the traffic barricade.

Yet another object of the present invention is to provide a new reflective traffic guidance system which includes a traffic barrier with a front surface, a substrate on the traffic barrier positioned adjacent to the front surface of the traffic barrier, and a reflective surface on the substrate for reflecting incident light in a substantially specular manner and being substantially incapable of reflecting incident light in a retroreflective manner. Optionally, the traffic barrier may comprise a traffic panel that may be placed on or over conventional concrete barriers or guardrails or may be used alone.

Still yet another object of the present invention is to provide a new reflective traffic barrricade that allows a person to see on coming or forward traffic by using the reflective barrier itself.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
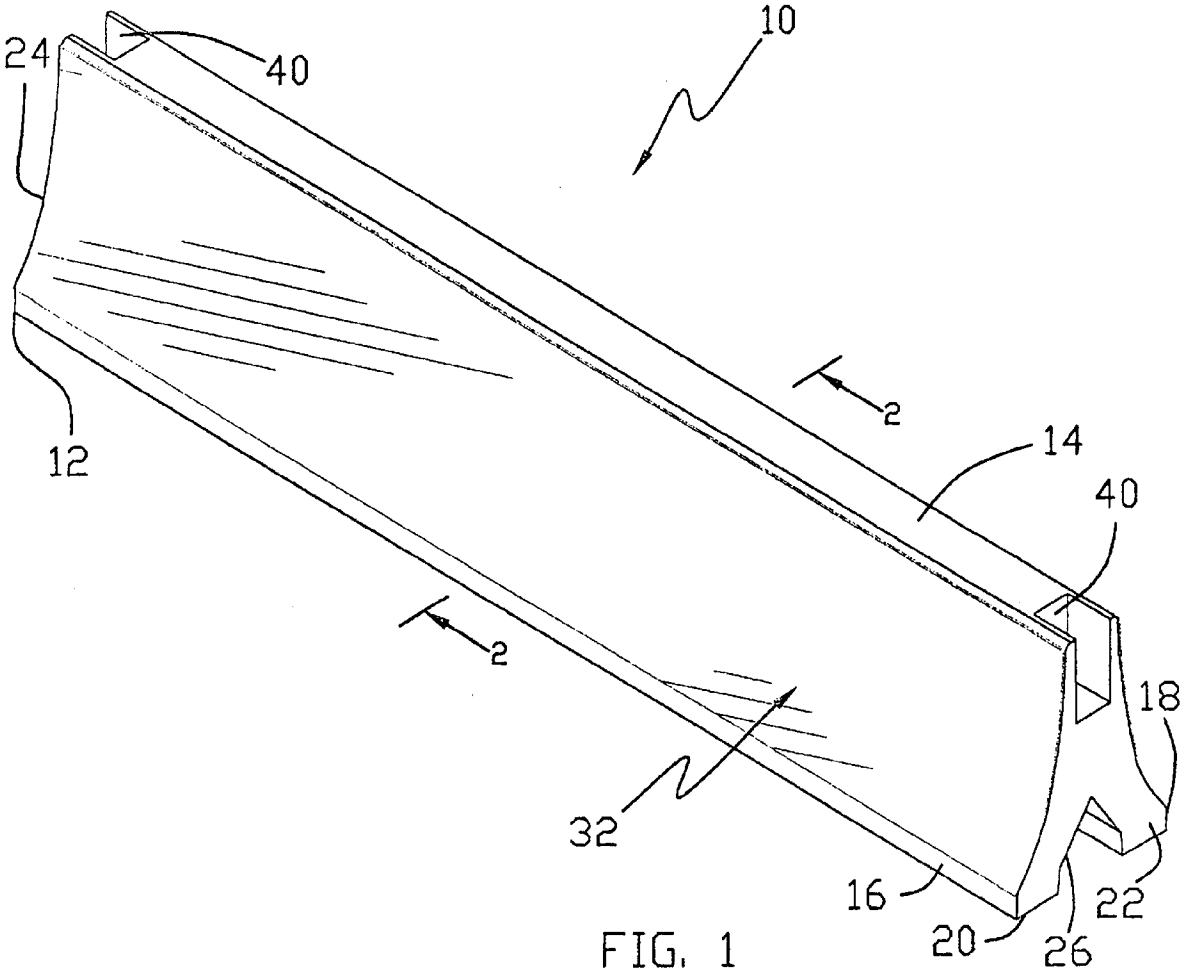
FIG. 1 is a schematic perspective view of a new reflective traffic barrricade according to the present invention.
Figure 3:
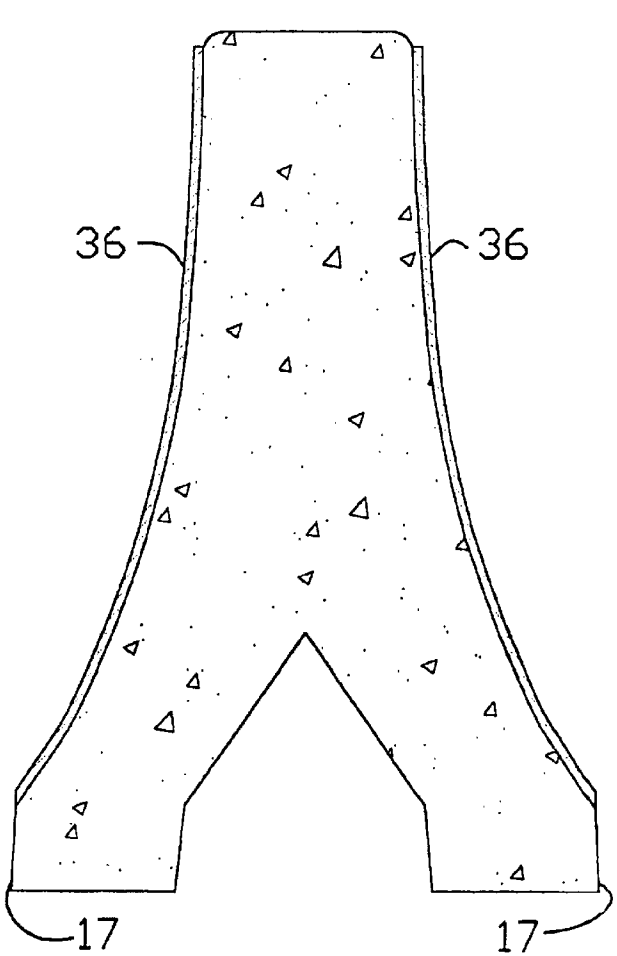
FIG. 3 is a schematic cross sectional view of the present invention.
Figure 2:
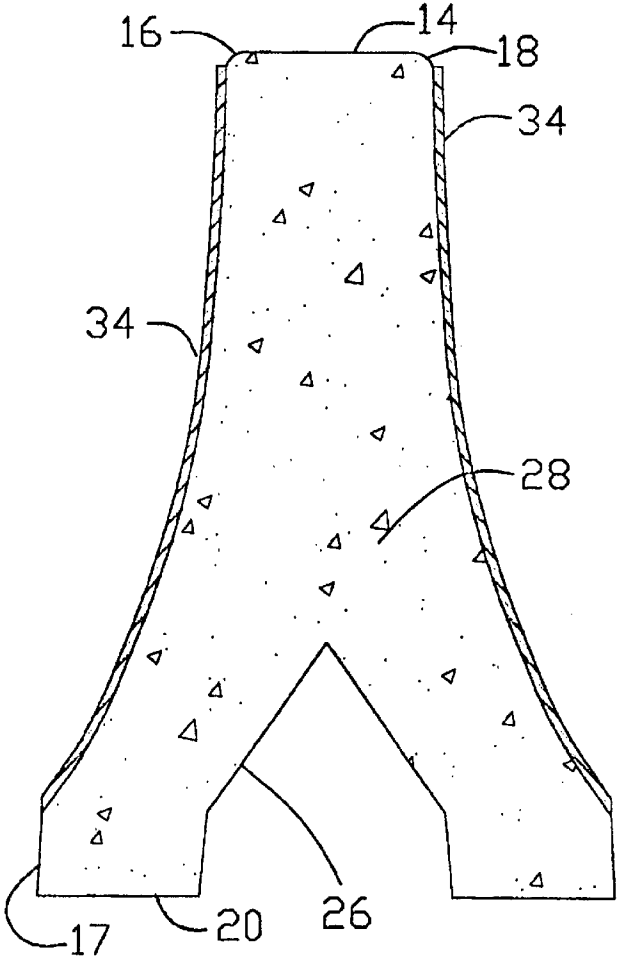
FIG. 2 is a schematic cross sectional view taken along line 2—2 of the present invention.
Figure 4:
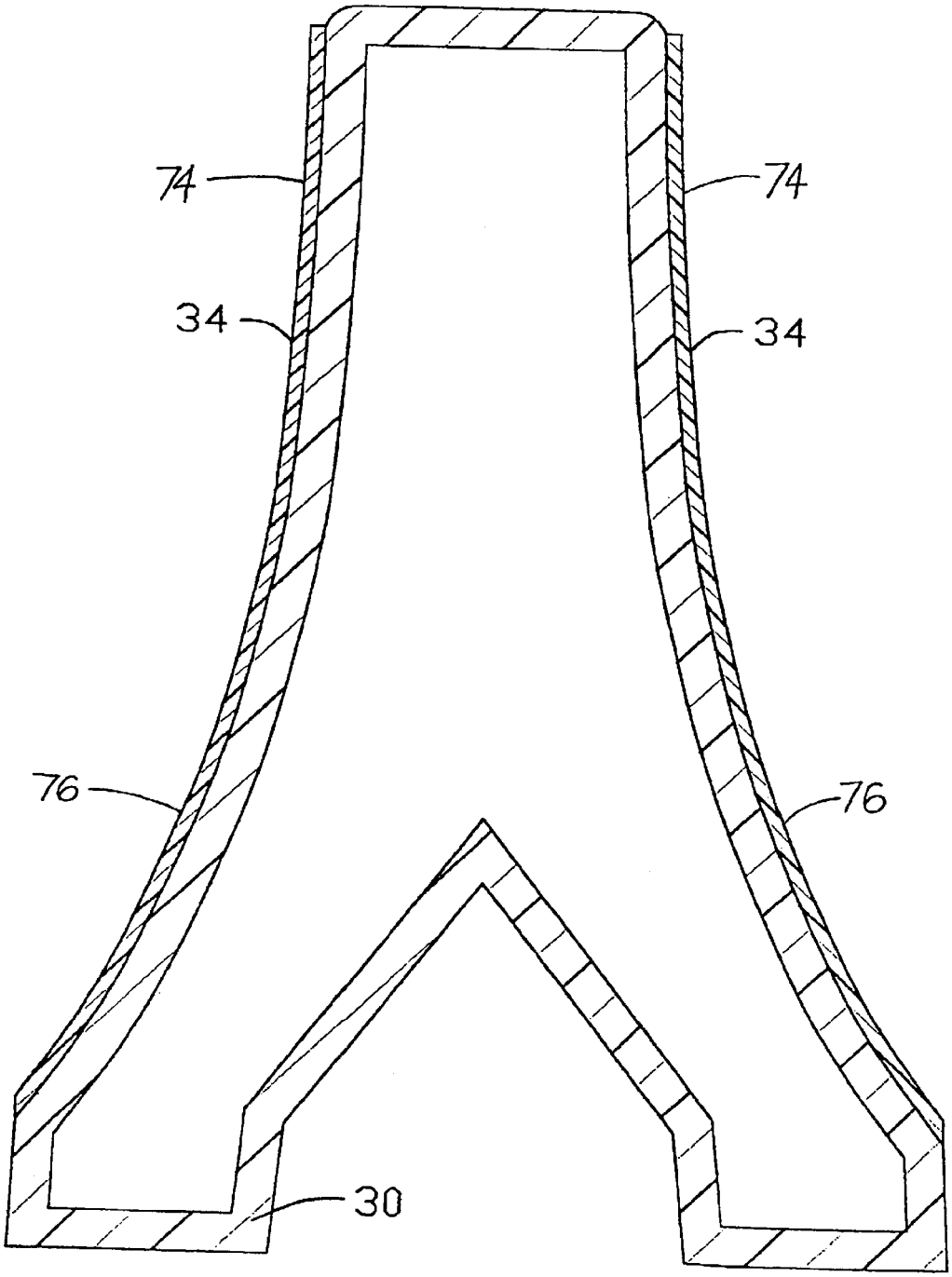
FIG. 4 is a schematic cross-sectional view of the present invention.

With reference now to the drawings, and in particular to FIGS. 1 through 8 thereof, a new reflective traffic barrricade system embodying the principles and concepts of the present invention and generally designated by the reference numeral 10 will be described.

As best illustrated in FIGS. 1 through 4, the reflective traffic barrricade system 10 may generally comprise a blocking member 12. The blocking member comprises an elongate member having a top side 14, a front side 16, a back side 18, a bottom side 20, a first end 22 and a second end 24. A substantially vertical portion 17 is located adjacent to the bottom side 20 on both the front and back sides of the blocking member. The elongate member, or blocking member 12, may have an inverted Y-shape in a plane taken transverse to a longitudinal cross-section of the elongate member such that a slot 26 extends upwardly into the bottom side 20. The front side 16 and the back side 18 each have a generally concave shaped surface.

In one illustrative embodiment of the invention, the substantially vertical portions of the elongate member preferably have a height between approximately 0.1 meters and approximately 0.3 meters. The elongate member 12 has length generally equal to 6 meters, and a height generally between 0.8 meters and approximately 1.2 meters. The bottom side 20 of the elongate member may have a width preferably between approximately 0.6 meters and approximately 0.8 meters, and the top side 14 has a width preferably between approximately 0.2 and approximately 0.3 meters.

The elongate member 12 preferably comprises a substantially rigid material which is ideally concrete 28, although hollow plastic 30 materials are also envisioned. If plastic is used, the device is preferably filled with water and has a length of 2 meters. The device 10, if made from plastic, may also have an internal steel (or other metal) framework for added weight, strength and stability.

In one embodiment of the invention, each of the first and second ends of the blocking member has a slot 40 therein. The slot 40 extends into the first 22 and second 24 ends and into the top side 14. When multiple blocking members are placed end-to-end, steel hollow sections or cement grout may be positioned in the slot of adjacent members to secure them together. In one illustrative embodiment of the invention, the slots are approximately 100 mm wide, approximately 50 mm deep, and approximately 600 mm high.

In one highly preferred embodiment of the invention, the top side has a width of approximately 262 mm and the bottom side a width of approximately 600 mm. The device has a height equal to approximately 1000 mm. A vertical line extending through the top side and through the bottom side defines a median. The arc of the front and back sides has a top portion extending downwardly approximately 500 mm from the top side, and a bottom portion extending from the top portion downwardly approximately 300 mm. The downward measurements are taken along the median. The top, or first, portion 74 of the arcs extend inward toward the median such that approximately 100 mm from the top side, the width of the device is approximately 252.8 mm, approximately 200 mm from the top side the width is approximately 250 mm which is the narrowest part of the device. At approximately 200 mm from the top side, the arc begins to start outward again. At approximately 300 mm from the top side the width is approximately 252.8 mm, at approximately 400 mm the width is approximately 262 mm, and at approximately 500 mm down along the median the width is approximately 276 mm at which the bottom, or second, portion 76 of the arc begins. The bottom arc has a greater curvature than the top arc, so that at approximately 600 mm from the top side the width is equal to approximately 306 mm, at approximately 700 mm the width is equal to 388 mm, and at approximately 800 mm from the top side the width is approximately 525 mm. At the bottom of the bottom arc, the front and back sides are angled downward toward the bottom side to define the generally vertical portions 17.

To further explain the above, the top arc is formed by a first circle having a radius of approximately 3500 mm and the bottom arc is formed by a circle having a radius of approximately 1050. The first circle is tangent to a first line parallel to the median and approximately 125 mm from the median. The first circle is tangent to the first line approximately 200 mm from the top side. The top portion of the arc has a measurement generally equal to approximately 0.143 radians, or approximately 8.13 degrees. A second circle having a radius of approximately 470 mm forms the bottom arc. The second circle is tangent to the first circle at a point approximately 500 mm from the top side and approximately 138 mm from the median where the radii of the first circle and the second circle coincide. The bottom portion of the arc has a measurement generally equal to approximately 0.74 radians, or approximately 42.4 degrees. The top arc smoothly transitions into the bottom arc. It should be noted that the top and bottom arcs are located on both sides of the device.

A significant aspect of the invention is a reflective means 32 provided on the blocking member for generally reflecting an image of a light source. The reflective means is securely attached to and generally covers or coats a substrate, such as the front side 16 and the back side 18 of the elongate member. The reflective means 32 may be any conventional reflecting material capable of reflecting a true image and preferably comprises a conventional acrylic mirror 34 adhered to the front and back sides. Also envisioned is the used of reflective metal 36.

The reflective means of the invention is characterized by being capable of reflecting an image in a manner that the image may be perceived in the reflected light by a person viewing the reflected light. The most effective and suitable reflective means for use in the invention provides a high degree of specular reflectivity in which the reflected light is reflected from a surface of the reflective means along an axis that is oriented at an angle with respect to the surface that is substantially equal to the axis of the incident light with respect to the surface. The most effective and suitable reflective means also provides little or no retroreflectivity of the light back to its source. Since the portion of the incident light that is retroreflected back towards that light source is light that is not reflected towards other vehicles for enhancing visibility, any significant degree of retroreflectivity diminishes the effectiveness of the reflective means for the intended purpose of the invention. Thus, the reflective means for the purposes of the invention should have only a minimal retroreflective character.

One highly preferred reflective means comprises a smooth surface on the substrate (such as the blocking member, and may comprise a polished surface (for example, stainless steel or acrylic) on the substrate, or the surface of a glossy coating (for example, high gloss paint) on the substrate.

Optionally, blocking members 12 having only one curved side are also envisioned so that the blocking members may be used as bridge parapets. The size of the blocking members may be altered for the desired need.

In use, the elongate members 12 are placed end to end to block traffic as traditional blocking members are used for. The concave front 16 and back 18 sides provide an image of vehicles ahead of the blocking members. The reflective means 32 assist the driver of a vehicle in seeing forward traffic that might otherwise be blocked by traffic in front of the driver.

Figure 5:
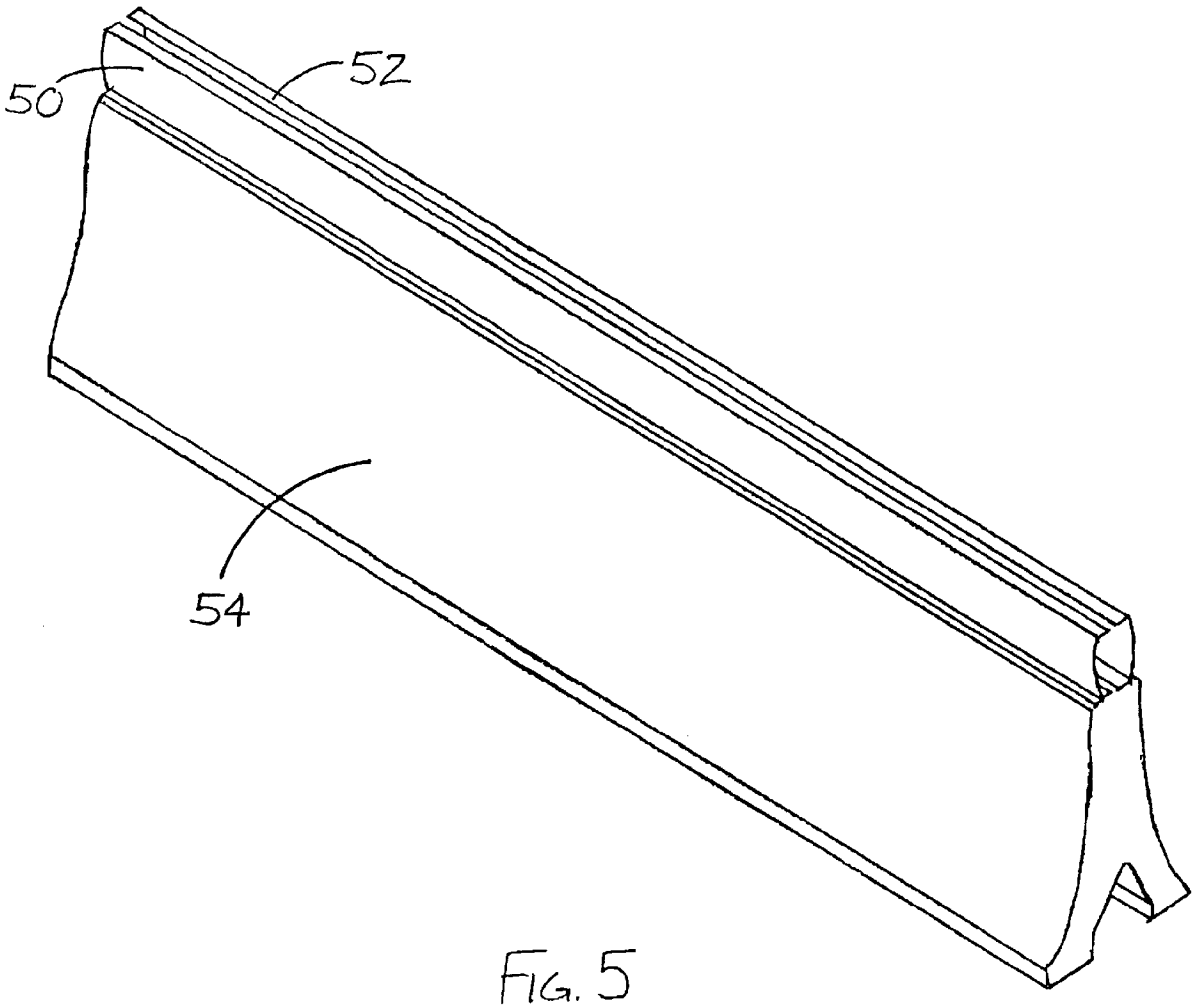
FIG. 5 is a schematic perspective view of a pair of reflective traffic panels of the present invention positioned in a back-to-back arrangement atop a conventional concrete traffic barrier.
Figure 6:
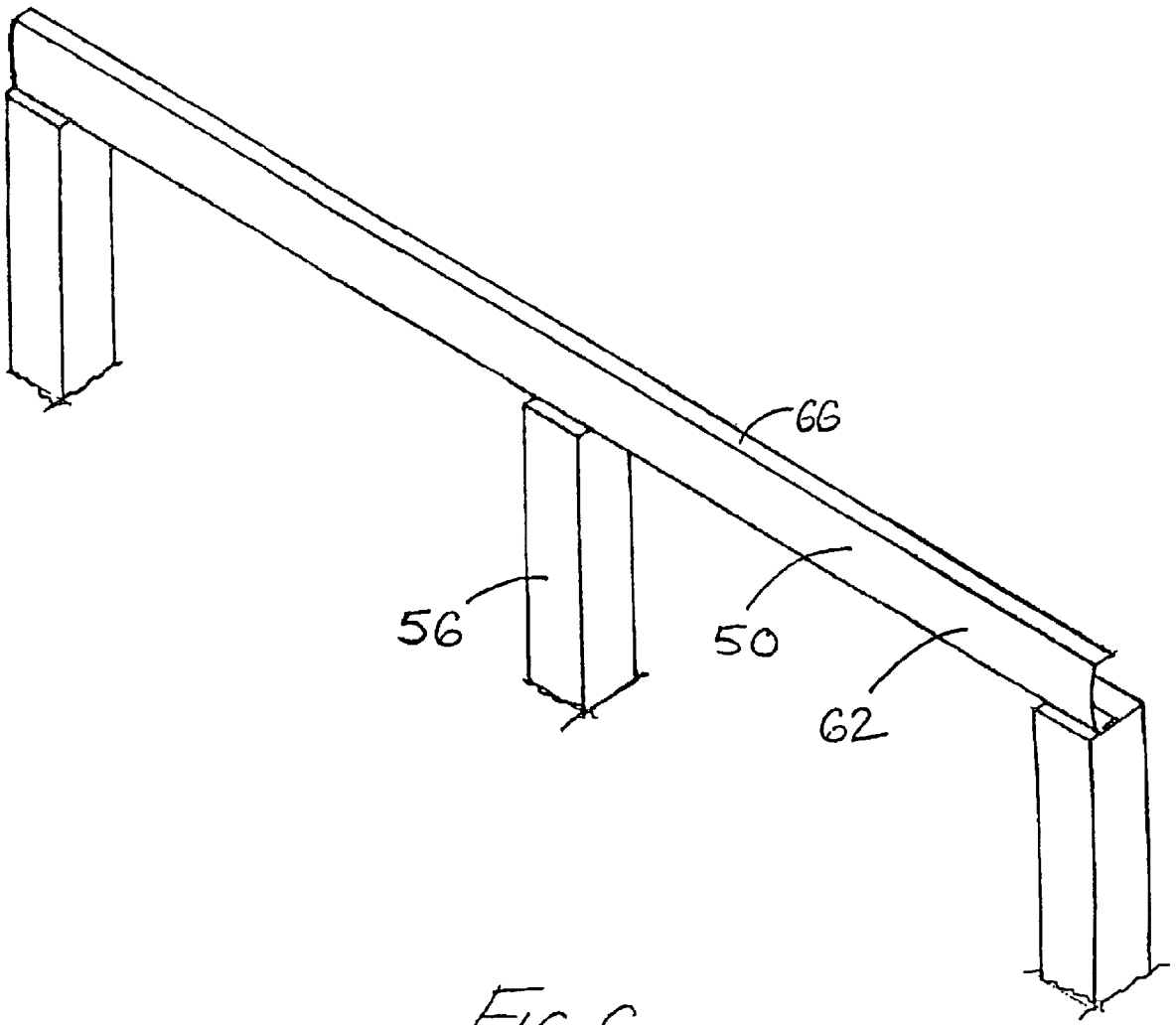
FIG. 6 is a schematic perspective view of a single one of the reflective traffic panels of the present invention mounted on a series of posts.
Figure 7:
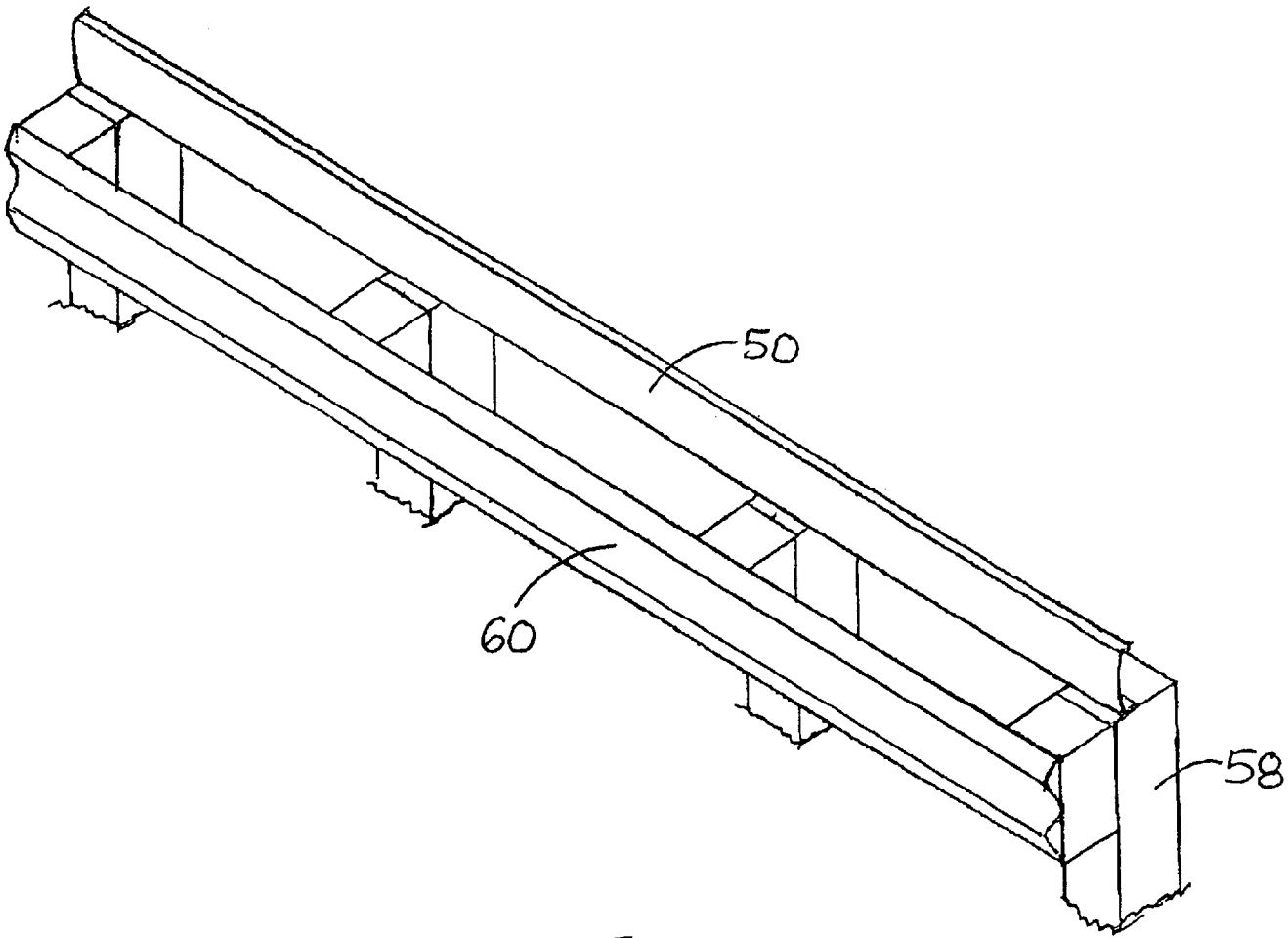
FIG. 7 is a schematic perspective view of a single reflective traffic panel mounted on a series of posts in combination with a horizontal traffic barrier.

In an optional embodiment of the invention, the traffic barrier may comprise a traffic panel 50 that may be mounted in various manners on traffic barriers or other structures positioned adjacent to a road. For example, as shown in FIG. 5, first 50 and second 52 traffic panels are mounted in a "back-to-back" orientation on top of a concrete barrier 54. In another example, as shown in FIG. 6, the traffic panel 50 is rested on the top of a plurality of posts 56. In yet another example, as shown in FIG. 7, the traffic panel 50 is positioned on posts 58 that also support a horizontal traffic barrier 60 (such as, for example, a guardrail formed of a metal, illustratively steel).

The traffic panel 50 may have a front wall 62 with the front surface 72 thereon. The front wall 62 may be arcuate about a substantially horizontal axis such that the front surface 72 is convex. The traffic panel 50 may also have a bottom wall 64 that extends from a bottom of the front wall 62 and a top wall 66 that extends from the front wall. The top 66 and bottom 64 walls may extend in substantially parallel planes. Illustratively, the thickness of the walls 62, 64, and 66 may be between approximately 0.4 mm to approximately 1.0 mm.

Figure 8:
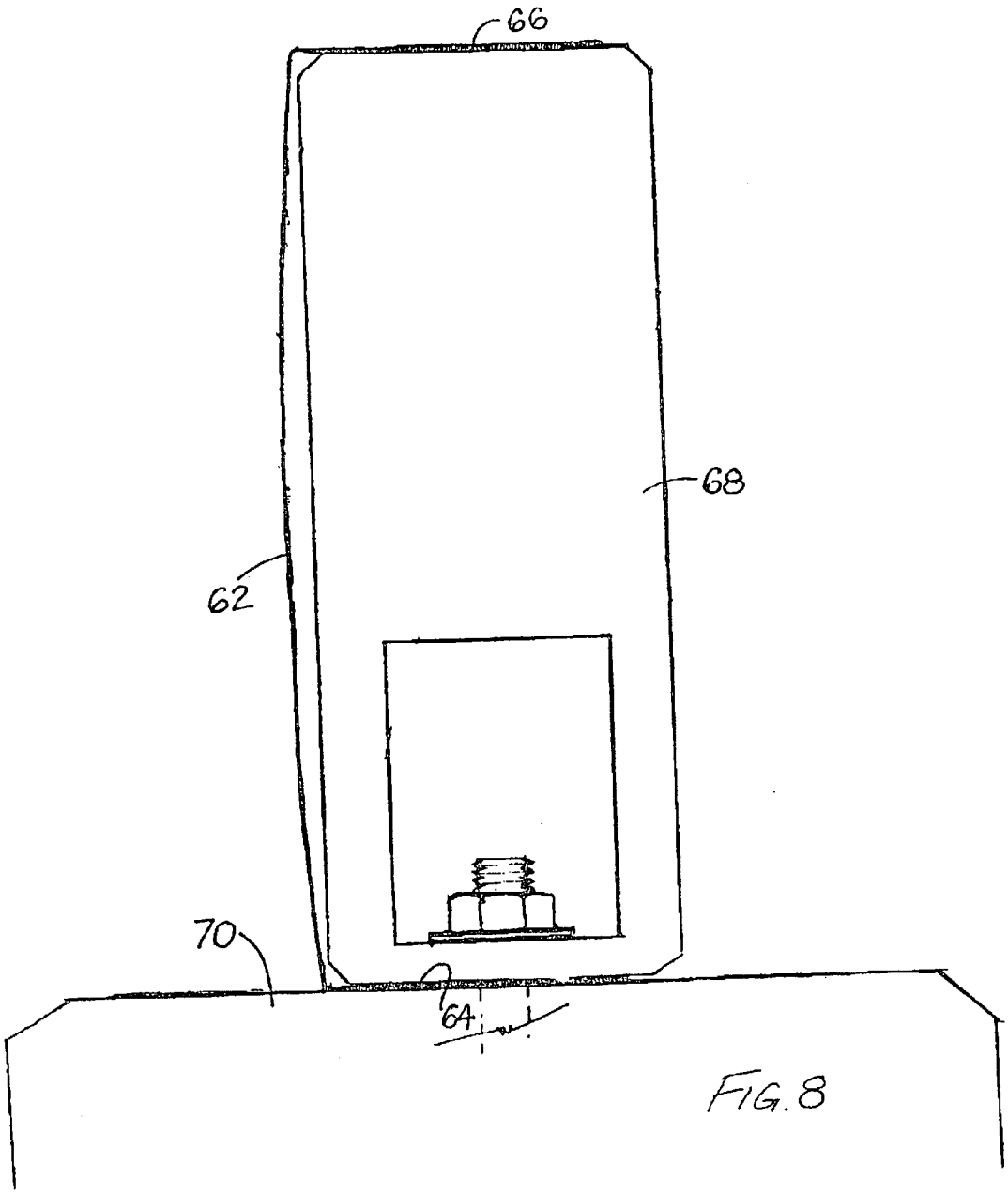
FIG. 8 is a schematic cross sectional view of a traffic barrier having the reflective traffic panel of the present invention mounted thereon.

In another variation of the invention as shown in FIG. 8, the traffic panel 50 is wrapped about a portion of a horizontal traffic member 68 mounted on a support 70. Illustratively, the traffic member 68 may be formed, for example, of a plastic or a metal, and may measure approximately 200 mm high, approximately 100 mm long, and approximately 70 mm wide, and may include a cavity for permitting bolting to the support 70.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A reflective traffic guidance system comprising:

a traffic barrier with a front surface;

a substrate on the traffic barrier positioned adjacent to the front surface of the traffic barrier; and a reflective means on the substrate for reflecting incident light in a substantially specular manner, the reflective means being substantially incapable of reflecting incident light in a retroreflective manner;

wherein the traffic barrier comprises a blocking member, the blocking member having a top side, a front side having the front surface thereon, the front wall being arcuate about a substantially horizontal axis such that the front surface is concave.

2. The system of claim 1 wherein the traffic barrier comprises a traffic panel with a front wall.

3. The system of claim 2 wherein the front surface is arcuate about a substantially horizontal axis such that the front surface is convex.

4. The system of claim 2 wherein the traffic panel includes a bottom wall extending from a bottom of the front wall and a top wall extending from the front wall, the top and bottom walls extending in substantially parallel planes.

5. The system of claim 1 wherein the reflective means on the substrate reflects incident light in a substantially specular manner substantially without reflecting incident light in a retroreflective manner.

6. The system of claim 1 wherein the blocking member has a back side with a back surface, the back wall being arcuate about a substantially horizontal axis such that the back surface is concave.

7. The system of claim 6 wherein the blocking member has a bottom side, a first end and a second end, the top side having a width less than a width of the bottom side.

8. The system of claim 7 wherein each of the front and back surfaces of the blocking member has a concave shape and a vertical axis, a first portion of the concave shape being curved such that a distance between a vertical midpoint of the first portion having a length to the vertical axis, the first portion having a pair of end points, each endpoint having an associated distance between the endpoint and the vertical axis having a end-length greater than the length between the midpoint and the vertical axis, the first portion having a regular curvature corresponding to a radius of approximately 3500 mm; and a second portion of the concave shape having a first end point, a second portion mid point and a second end point, the second portion being curved such that a distance between the first end point of the second portion having a length to the vertical axis, the second portion midpoint having an associated distance between the second portion midpoint and the vertical axis having a length greater than the length between the first end point and the vertical axis, the second portion second end point having an associated distance between the second end point and the vertical axis having a length greater than the length between the second portion midpoint and the vertical axis, the second portion having a regular curvature corresponding to a radius of approximately 1050 mm.

9. A reflective traffic guidance system comprising:

a traffic barrier with a front surface, the traffic barrier comprising a blocking member, the blocking member having a top side, a front side having the front surface thereon, the front wall being arcuate about a substantially horizontal axis such that the front surface is concave, the blocking member having a back side with a back surface, a bottom side, a first end and a second end, the top side having a width less than a width of the bottom side;

a substrate on the traffic barrier positioned adjacent to the front surface of the traffic barrier; and a reflective means on the substrate for reflecting incident light in a substantially specular manner, the reflective means being substantially incapable of reflecting incident light in a retroreflective manner;

wherein each of the front and back surfaces has a concave shape, the elongate member having a vertical axis, the first portion of the concave shape being curved such that a distance between a vertical midpoint of the first portion having a length to the vertical axis, the first portion having a pair of end points, each endpoint having an associated distance between the endpoint and the vertical axis having a end-length greater than the length between the midpoint and the vertical axis, the first portion having a regular curvature corresponding to a radius of approximately 3500 mm; and the second portion of the concave shape having a first end point, a second portion mid point and a second end point, the second portion being curved such that a distance between the first end point of the second portion having a length to the vertical axis, the second portion midpoint having an associated distance between the second portion midpoint and the vertical axis having a length greater than the length between the first end point and the vertical axis, the second portion second end point having an associated distance between the second end point and the vertical axis having a length greater than the length between the second portion midpoint and the vertical axis, the second portion having a regular curvature corresponding to a radius of approximately 1050 mm.

10. A reflective traffic dividing device, the device comprising:

a blocking member, the blocking member comprising an elongate member having a top side, a front side, a back side, a bottom side, a first end and a second end, the elongate member having an inverted Y-shape taken transverse to a longitudinal cross-section of the elongate member, the front side and the back side each having a generally concave shaped surface, the elongate member having length generally equal to 6 meters, the elongate member having a height generally equal to 1 meter, the bottom side of the elongate member having a width generally equal to 0.6 meters, the top side having a width generally equal to 0.262 meters, the elongate member comprising a substantially rigid material;

the elongate member having a vertical axis, the first portion of the concave shape being curved such that a distance between a vertical midpoint of the first portion having a length to the vertical axis, the first portion having a pair of end points, each endpoint having an associated distance between the endpoint and the vertical axis having a end-length greater than the length between the midpoint and the vertical axis, the first portion having a regular curvature corresponding to a radius of approximately 3500 mm;

the second portion of the concave shape having a first end point, a second portion mid point and a second end point, the second portion being curved such that a distance between the first end point of the second portion having a length to the vertical axis, the second portion midpoint having an associated distance between the second portion midpoint and the vertical axis having a length greater than the length between the first end point and the vertical axis, the second portion second end point having an associated distance between the second end point and the vertical axis having a length greater than the length between the second portion midpoint and the vertical axis, the second portion having a regular curvature corresponding to a radius of approximately 1050 mm; and a reflective means on the substrate for reflecting incident light in a substantially specular manner, the reflective means being substantially incapable of reflecting incident light in a retroreflective manner, the reflective means comprising an acrylic mirror.

11. A reflective traffic guidance system comprising:

a traffic barrier with a front surface;

a substrate on the traffic barrier positioned adjacent to the front surface of the traffic barrier;

a reflective means on the substrate for reflecting incident light in a substantially specular manner, the reflective means being substantially incapable of reflecting incident light in a retroreflective manner;

wherein the traffic barrier comprises a traffic panel with a front wall; and wherein the traffic panel includes a bottom wall extending from a bottom of the front wall and a top wall extending from the front wall, the top and bottom walls extending in substantially parallel planes.

12. The system of claim 11 wherein the front surface is arcuate about a substantially horizontal axis such that the front surface is convex.

* * * * *